US006143166A

United States Patent [19]

Nacamuli

[11] Patent Number: 6,143,166

[45] Date of Patent: Nov. 7, 2000

[54] PROCESS FOR PRODUCTION OF AROMATICS IN PARALLEL REFORMERS WITH AN IMPROVED CATALYST LIFE AND REDUCED COMPLEXITY

[75] Inventor: Gerald J. Nacamuli, Mill Valley, Calif.

[73] Assignee: Chevron Chemical Co. LLC, San Ramon, Calif.

[21] Appl. No.: 09/375,196

[22] Filed: Aug. 16, 1999

Related U.S. Application Data

[60] Provisional application No. 60/096,826, Aug. 17, 1998.

[51] Int. Cl.[7] ..... C10G 59/02; C10G 35/085; C10G 35/06

[52] U.S. Cl. ..... 208/65; 208/64; 208/141; 585/321; 585/322

[58] Field of Search ..... 208/65, 64, 138, 208/141; 585/321, 322

[56] References Cited

U.S. PATENT DOCUMENTS

| | | | |
|---|---|---|---|
| Re. 33,323 | 9/1990 | Roarty et al. | 208/79 |
| 2,867,576 | 1/1959 | Honeycutt | 208/65 |
| 2,944,959 | 7/1960 | Kline et al. | 208/79 |
| 3,003,949 | 10/1961 | Hamilton | 208/79 |
| 3,018,244 | 1/1962 | Stanford et al. | 208/79 |
| 3,172,841 | 3/1965 | Paterson | 208/79 |
| 3,409,540 | 11/1968 | Gould et al. | 208/79 |
| 3,431,195 | 3/1969 | Storch et al. | 208/101 |
| 3,516,924 | 6/1970 | Forbes | 208/65 |
| 3,753,891 | 8/1973 | Graven et al. | 208/62 |
| 3,776,949 | 12/1973 | Gelbein et al. | 260/515 |
| 3,864,240 | 2/1975 | Stone | 208/64 |
| 4,104,320 | 8/1978 | Bernard et al. | 260/673.5 |
| 4,157,355 | 6/1979 | Addison | 585/321 |
| 4,212,726 | 7/1980 | Mayes | 208/101 |
| 4,213,849 | 7/1980 | Engelhard et al. | 208/139 |
| 4,347,394 | 8/1982 | Detz et al. | 585/419 |
| 4,483,766 | 11/1984 | James, Jr. | 208/134 |
| 4,568,451 | 2/1986 | Greenwood et al. | 208/340 |
| 4,613,424 | 9/1986 | Schorfheide | 208/65 |
| 4,645,586 | 2/1987 | Buss | 208/65 |
| 5,157,180 | 10/1992 | West et al. | 285/313 |
| 5,178,751 | 1/1993 | Pappas | 208/340 |
| 5,278,344 | 1/1994 | Gosling et al. | 585/322 |
| 5,332,492 | 7/1994 | Maurer et al. | 208/340 |
| 5,391,292 | 2/1995 | Schorfheide et al. | 208/140 |
| 5,602,290 | 2/1997 | Fallon | 585/448 |
| 5,935,415 | 9/1999 | Haizmann et al. | 208/64 |
| 5,958,217 | 9/1999 | Nacamuli et al. | 208/65 |

*Primary Examiner*—Bekir L. Yildirim
*Attorney, Agent, or Firm*—David M. Tuck

[57] ABSTRACT

This process relates to reforming a full-boiling range hydrocarbon feed in two parallel stages while maximizing the catalyst life of the heavy cut reformer and/or reducing the complexity of the plant by preferentially sending the higher purity Aromax® hydrogen to the heavy cut reformer.

17 Claims, 2 Drawing Sheets

Split-Feed, Two-Stage Aromatization

Split-Feed, Two-Stage Aromatization

Split-Feed, Two-Stage Aromatization

PROCESS FOR PRODUCTION OF AROMATICS IN PARALLEL REFORMERS WITH AN IMPROVED CATALYST LIFE AND REDUCED COMPLEXITY

This patent application claims priority from Provisional application Ser. No. 60/096,826 filed Aug. 17, 1998.

FIELD OF THE INVENTION

The present invention relates to reforming a full-boiling range hydrocarbon feed in two parallel stages while maximizing the catalyst life of the heavy cut reformer.

BACKGROUND OF THE INVENTION

The reforming of petroleum hydrocarbon streams is an important petroleum refining process that is employed to provide high-octane hydrocarbon blending components for gasoline. The process is usually practiced on a straight run naphtha fraction that has been hydrodesulfurized. Straight run naphtha is typically highly paraffinic in nature, but may contain significant amounts of naphthenes and minor amounts of aromatics or olefins. In a typical reforming process, the reactions include dehydrogenation, cyclization, isomerization, and hydrocracking. The dehydrogenation reactions typically will be the dehydroisomerization of alkylcyclopentanes to aromatics, the dehydrogenation of paraffins to olefins, the dehydrogenation of cyclohexanes to aromatics, and the dehydrocyclization of paraffins to aromatics. The aromatization of the n-paraffins to aromatics is generally considered to be the most important because of the high octane of the resulting aromatic product compared to the low octane ratings for n-paraffins. The isomerization reactions include isomerization of n-paraffins to isoparaffins, and the isomerization of substituted aromatics. The hydrocracking reactions include the hydrocracking of paraffins and hydrodesulfurization of any sulfur that is remaining in the feedstock.

It is well known in the art that several catalysts are capable of reforming petroleum naphthas and hydrocarbons that boil in the gasoline boiling range. Examples of known catalysts useful for reforming include platinum and optionally rhenium or iridium on an alumina support, platinum on zeolite X and zeolite Y, platinum on intermediate pore size zeolites as described in U.S. Pat. No. 4,347,394, and platinum on cation exchanged zeolite L. U.S. Pat. No. 4,104,320 discloses the dehydrocyclization of aliphatic hydrocarbon to aromatics by contact with a catalyst comprising a zeolite L containing alkali metal ions and a Group VIII metal such as platinum.

The conventional reforming catalyst is a bifunctional catalyst that contains a metal hydrogenation-dehydrogenation component, which is usually dispersed on the surface of a porous inorganic oxide support, usually alumina. Platinum has been widely used commercially in the production of reforming catalysts, and platinum on alumina catalysts have been commercially employed in refineries for the past few decades. More recently, additional metallic components have been added to the platinum to further promote the activity or selectivity, or both. Examples of such metallic components are iridium, rhenium, tin and the like. Some catalysts possess superior activity, or selectivity, or both as contrasted with other catalysts. Platinum-rhenium catalysts, for example, possess high selectivity in comparison to platinum catalysts. Selectivity is generally defined as the ability of the catalyst to produce high yields of desirable products with concurrent low production of undesirable products, such as gaseous hydrocarbons.

It is desirable to maximize xylene and benzene production and ultimately para-xylene and benzene production. The problem of how to do this has not been previously solved. The prior art has dealt with the problem of maximizing only benzene production when processing a wide boiling $C_5$–$C_{11}$ naphtha but has not addressed how to maximize first para-xylene production and secondly benzene production. Note that maximizing benzene production should not occur by downgrading $C_8$ and $C_9$ aromatics to benzene. This is especially important as para-xylene has historically commanded a premium above benzene.

There exist several processes for dividing naphtha feedstreams into a higher boiling cut and a lower boiling cut and reforming these cuts separately. U.S. Pat. No. 2,867,576 discloses separating straight run naphtha into lower and higher boiling cuts, in which the higher boiling cuts are reformed with a hydrogenation-dehydrogenation catalyst with the liquid reformate produced being routed to an aromatics separation process. The paraffinic fraction obtained from the separation process is blended with the lower boiling naphtha fraction and the resulting blend is reformed with a reforming catalyst, which may or may not be the same type employed in reforming the high boiling cut.

U.S. Pat. No. 2,944,959 discloses fractionating a full straight run gasoline into a light paraffinic fraction, $C_5$ and $C_6$, that is hydroisomerized with hydrogen and a platinum-alumina catalyst, a middle fraction that is catalytically reformed with hydrogen and a platinum-alumina catalyst, and a heavy fraction that is catalytically reformed with a molybdenum oxide catalyst and recovering the liquid products. U.S. Pat. Nos. 3,003,949, 3,018,244 and 3,776,949 also disclose fractionating a feed into a $C_5$ and $C_6$ fraction, that is isomerized, and a heavier fraction that is reformed.

Other processes for dividing feedstocks and separately treating them include: U.S. Pat. Nos. 3,172,841 and 3,409,540 disclose separating a hydrocarbon feedstock into fractions and catalytically reforming various fractions of the feed; U.S. Pat. No. 4,167,472 discloses separating straight chain from non-straight chain $C_6$–$C_{10}$ hydrocarbons and separately converting to aromatics; and U.S. Pat. No. 4,358,364 discloses catalytically reforming a $C_6$ fraction and producing additional benzene by hydrogasifying a $C_5^-$ fraction, a fraction with a boiling point above 300° F. and the gas stream produced from catalytic reforming.

U.S. Pat. No. 3,753,891 discloses fractionating a straight run naphtha into a light naphtha fraction containing the $C_6$ and a substantial portion of the $C_7$ hydrocarbons and a heavy naphtha fraction boiling from about 200° to 400° F.; then reforming the light fraction to convert naphthenes to aromatics over a platinum-alumina catalyst or a bimetallic reforming catalyst; separately reforming the heavy faction, then upgrading the reformer effluent of the low boiling fraction over a ZSM-5 type zeolite catalyst to crack the paraffins and recovering an effluent with improved octane rating.

U.S. Pat. No. 4,645,586 discloses parallel reforming of the same hydrocarbon feed with two different reforming catalysts. The hydrocarbon feed of a given composition is physically (or mechanically) split into two streams, A & B, which have the same composition. Stream A, is reformed with an acidic catalyst. Stream B, is reformed with a non-acidic catalyst. The patent is otherwise silent as to the composition of each fraction. Preferably, the acidic bi-functional reforming catalyst is not presulfided.

U.S. Pat. No. 4,897,177 discloses using a monofunctional catalyst to reform a hydrocarbon fraction having less than 10% by volume of $C_{9+}$ hydrocarbons. This fraction is either a $C_6$, $C_7$, $C_8$, $C_6$–$C_7$, $C_7$–$C_8$, or $C_6$–$C_8$ fraction, with the most preferred being a $C_6$–$C_8$ fraction. That fraction can contain up to 15 vol. % hydrocarbons outside the named range (col. 3, line 44–49). A heavier fraction can be reformed using a bifunctional catalyst on an acidic metal oxide. That bifunctional catalyst can be a Pt/Sn/alumina catalyst.

U.S. Reissue Pat. No. 33,323 discloses solvent extraction of a light fraction of a reformate. The goal of that patent is to maximize benzene production only. A hydrocarbon feed is separated into a lighter fraction (a $C_6$ cut that contains 15–35 lv % $C_{7+}$) and a heavier fraction (all remaining $C_7$ and heavier components). The lighter fraction is reformed in the presence of a non-acidic catalyst to maximize benzene yield. The heavier fraction is reformed in the presence of an acidic catalyst. The reformate from the non-acidic catalyst is introduced into an aromatics extraction process where an aromatic extract stream and a non-aromatic raffinate stream are recovered. The raffinate stream can be recycled to the feed.

The paper entitled "New Options For Aromatics Production" presented to the 20th Annual 1995 Dewitt Petrochemical Review (Houston, Tex., Mar. 21–23, 1995) by J. D. Swift et al. related recent improvements in UOP's process for the production of benzene and para-xylene. Case studies were presented to demonstrate the benefits of using that process to increase total aromatics production from a fixed quantity of naphtha. One configuration of that process involved a split-feed parallel aromatization processing scheme, but it is unclear what the composition is of each feed to each aromatization process.

U.S. Pat. No. 4,483,766 discloses purification of the hydrogen produced by a catalytic reformer followed by recycling of at least a portion of the substantially pure hydrogen to the inlet to the reformer. This patent requires a hydrogen separation/purification zone to remove impurities from the hydrogen produced by the reformer.

SUMMARY OF THE INVENTION

According to the present invention a process for reforming/aromatizing hydrocarbons in two reforming zones operated in parallel is disclosed, comprising:

a) reforming hydrocarbons comprising a $C_6$–$C_7$ cut over a monofunctional, non-acidic aromatization catalyst at reforming conditions to form a reformate comprising benzene and a gas comprising hydrogen having a hydrogen purity of at least 88 mole %, and b) feeding at least a portion of the gas comprising hydrogen and a hydrocarbon feed comprising a $C_{8+}$ cut to a bifunctional reformer, using a bifunctional, acidic reforming catalyst, under reforming conditions to form a $C_8$ aromatic product comprising xylenes.

Among other factors the present invention is based on my conception and unexpected finding that the catalyst life of the reformer using the bifunctional acidic catalyst can be significantly improved by preferentially using hydrogen produced by a monofunctional, non-acidic aromatization catalyst instead of the recycle hydrogen from the bifunctional reformer itself. The hydrogen purity of the hydrogen stream produced by the monofunctional catalyst is substantially higher than that produced by the bifunctional catalyst. Use of such a processing scheme allows an increase in the hydrogen gas purity reaching the bifunctional reformer catalyst while minimizing the total gas flow rate to the reformer. An additional advantage of the present invention is that the total compressor horsepower can be minimized for the complex thus reducing the complexity of the plant and thus reducing the capital and/or operating costs.

Thus the present invention comprises preferential routing of the higher hydrogen purity off gas from the non-acidic, monofunctional reformer to the bifunctional reformer. The use of the high hydrogen purity gas from the non-acidic, monofunctional reformer serves to increase the purity of the hydrogen reaching the bifunctional reformer. Higher purity hydrogen reaching the bifunctional reformer, increases the reactor hydrogen partial pressure, which in turn can serve to increase the catalyst life of the bifunctional catalyst by reducing the rate of coking.

Alternatively, if increased run length is not desired, then a constant hydrogen partial pressure can be maintained, due to the higher hydrogen purity, by reducing the hydrogen to hydrocarbon mole ratio. This reduction in the mole ratio is achieved by reducing the recycle compressor pumping rate or re-circulation rate, which results in a reduction in the power requirement and hence a utility savings. The high purity hydrogen from the non-acidic, monofunctional reformer can supply the entire hydrogen demand of the bifunctional reformer or can supply a portion of the hydrogen demand of the bifunctional reformer. In the latter case, this is accomplished by displacing a portion of the hydrogen recycle for the bifunctional reformer.

An alternative embodiment of the present invention comprises a process for reforming hydrocarbons in two reforming zones comprising:

a) reforming hydrocarbons comprising a $C_{6+}$ cut over a monofunctional, non-acidic aromatization catalyst at reforming conditions to form a reformate comprising benzene and a gas comprising hydrogen having a hydrogen purity of at least 88 mole %, and b) feeding at least a portion of the gas comprising hydrogen and a hydrocarbon feed comprising naphtha to a bifunctional reformer under reforming conditions to form a second reformate.

A preferred embodiment of the present invention is a process for reforming a full boiling hydrocarbon feed comprising:

separating the hydrocarbon feed into a $C_{5-}$ cut, a $C_6$–$C_7$ cut, and a $C_{8+}$ cut;

subjecting the $C_6$–$C_7$ cut to catalytic aromatization at elevated temperatures in a first reformer in the presence of hydrogen and using a non-acidic catalyst comprising at least one Group VIII metal and a non-acidic zeolite to produce a first reformate stream comprising benzene and a first gaseous stream comprising hydrogen; and subjecting the $C_{8+}$ cut in the presence of a hydrogen feed to catalytic aromatization at elevated temperatures in a second reformer and using an acidic catalyst comprising at least one Group VIII metal and a support to produce a second reformate stream comprising $C_8$ aromatics including xylenes and a second gaseous stream comprising hydrogen;

wherein at least a part of said first gaseous stream is fed to the second reformer to provide at least a part of said hydrogen feed.

Another alternative embodiment of the present invention comprises eliminating the need for a recycle compressor entirely for the bifunctional reformer. In this configuration all of the hydrogen to the bifunctional reformer is supplied by the non-acidic, monofunctional reformer on a once-through basis. Thus a recycle gas compressor and a recycle gas system is not needed as long as the monofunctional reformer is producing hydrogen. The system can also be designed such that the monofunctional reformer recycle gas compressor can be used as a recycle compressor for the bifunctional reformer when the monofunctional reformer is not operating. This embodiment of the present invention can provide a significant capital cost saving by eliminating a recycle compressor which is an expensive component of the plant.

BRIEF DESCRIPTION OF THE DRAWINGS

In order to assist the understanding of this invention, reference will now be made to the appended drawings. The drawings are exemplary only, and should not be construed as limiting the invention.

DETAILED DESCRIPTION OF THE DRAWINGS

Figure 1:
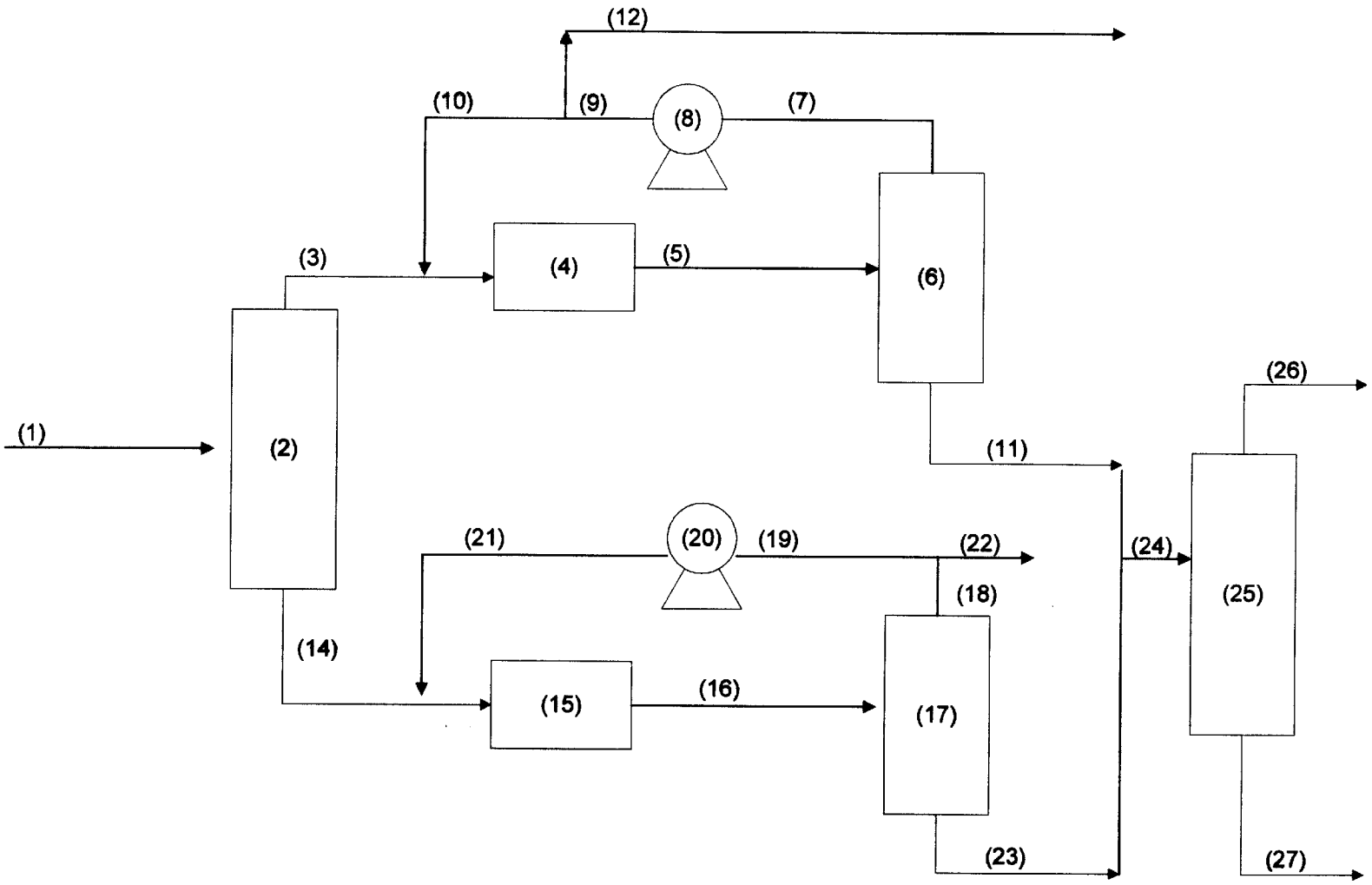
FIG. 1 shows a flow diagram of split-feed, two stage reforming using a monofunctional reformer operated in parallel with a bifunctional reformer.

FIG. 1 shows a flow diagram of split-feed, two stage reforming using a monofunctional reformer operated in parallel with a bifunctional reformer. Mass flow rates are provided for illustrative purposes only and not intended to limit the scope of the invention. Stream (1) is a broad boiling range $C_6$ to $C_{10}$ naphtha that is fed to a $C_7/C_8$ splitter column (2). The feed rate to the splitter column is 25,755 barrels per operating day (BPOD) or approximately 270,014 pounds per hour (lb/hr). The overhead stream (3) from the $C_7/C_8$ splitter is a predominately $C_6$–$C_7$ hydrocarbon feed that is sent to an Aromax reformer (4) containing non acidic Pt L zeolite catalyst. The feed rate of the $C_6$–$C_7$ feed to the Aromax reformer is 12,800 BPOD or 129,012 lb/hr. 36,895 lb/hr of recycle hydrogen containing gas (stream 10) is combined with the $C_6$–$C_7$ feed that is fed to the Aromax reformer. The Aromax reformer is operated at 75 psig. The hydrogen to hydrocarbon ($H_2$/HC) feed mole ratio for the Aromax reformer is 5/1. The effluent from the Aromax reformer (5) goes to a separator (6) to separate the gaseous effluent (stream 7) from the liquid effluent (stream 11). The total gaseous effluent (stream 7) which has a mass flow rate of 51,499 lb/hr is routed to the recycle compressor (8). The compressed gaseous effluent (stream 9) exits the recycle compressor and is divided into a portion that is recycled (stream 10) to the Aromax reformer and a second portion, the net gas make (stream 12), which leaves the process. The Aromax reformer gas, which is the gaseous effluent from separator (6), has a hydrogen purity of 93.7 mole %. This is also true for the compressed gas (9) and the net gas (12). The net gas make (stream 12) is 14,604 lb/hr. The bottoms stream (stream 14) from the $C_7/C_8$ splitter (2) is predominately a $C_8$–$C_{10}$ feed. 12,955 BPOD or 141,002 lb/hr of the $C_8$–$C_{10}$ feed is fed to the conventional reformer (15) after combining with recycle gas stream 21. The conventional reformer for this illustration of the invention contains a Pt/Sn/Ci on alumina catalyst and is operated at 75 psig. The $H_2$/HC feed mole ratio is 3/1. The hydrogen partial pressure is 59 psia. The effluent from the conventional reformer, stream 16, is sent to separator (17) to separate the gaseous effluent (stream 18) from the liquid effluent (stream 23). The gaseous effluent (18) has a mass flow rate of 52,694 lb/hr. 30,345 lb/hr (stream 19) of the gaseous effluent from separator 17, is passed to the recycle compressor (20) while 22,349 lb/hr (stream 22) leaves the process as net gas make. The resulting compressed gaseous stream is stream 21. The gaseous effluent (stream 18) is 84.9 mole % hydrogen. The mass flow rate for stream 21 is 30,345 lb/hr and the hydrogen purity is 84.9 mole %. The compressed gas (stream 21) is combined with the $C_8$–$C_{10}$ feed (stream 14) and the combined feed is fed to the conventional reformer (15). The liquid effluent (stream 23) from the conventional reformer is combined with the liquid effluent (stream 11) from the Aromax reformer and the combined stream (stream 24) passed to the depentanizer (25). In the depentanizer the $C_5$-fraction (stream 26) is distilled overhead and the $C_{6+}$ fraction (stream 27) is passed on for further processing (not shown). Further processing can include aromatics recovery as well as production of paraxylene and benzene product.

Figure 2:
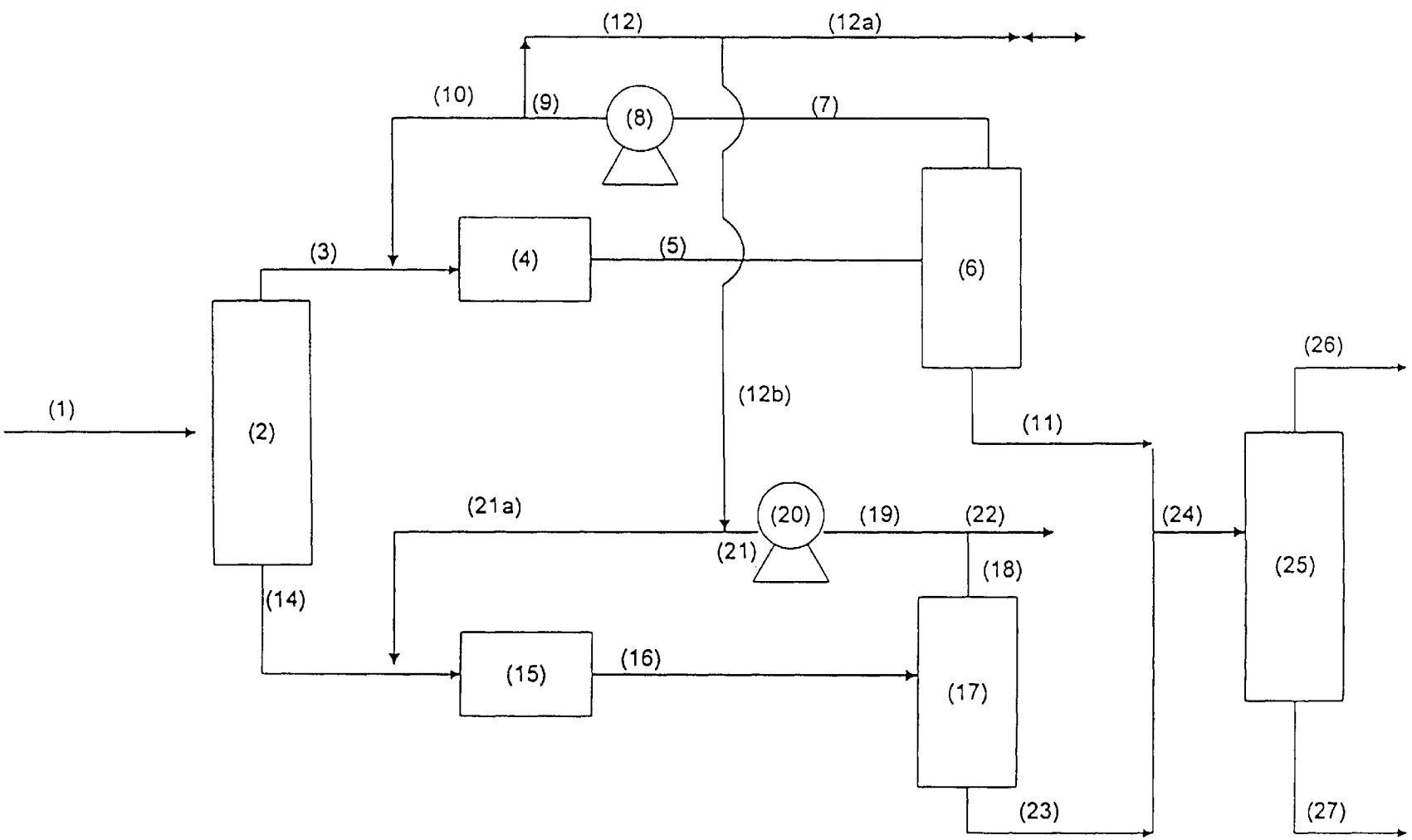
FIG. 2 shows a flow diagram of an embodiment of the present invention where the hydrogen from a monofunctional reformer is preferentially routed to a bifunctional reformer.

FIG. 2 shows a preferred embodiment of the present invention. This drawing and description is intended to help illustrate the invention only and is not intended to be limiting. Stream (1) is a broad boiling range $C_6$ to $C_{10}$ naphtha that is fed to a $C_7/C_8$ splitter column (2). The feed rate to the splitter column is 25,755 barrels per operating day (BPOD) or approximately 270,014 pounds per hour (lb/hr). The overhead from the $C_7/C_8$ splitter, stream 3, is a predominately $C_6$–$C_7$ hydrocarbon feed that is sent to an Aromax reformer (4) containing non acidic Pt L zeolite catalyst. The feed rate of the $C_6$–$C_7$ feed to the Aromax reformer is 12,800 BPOD or 129,012 lb/hr. 36,895 lb/hr of recycle hydrogen containing gas (stream 10) is combined with the $C_6$–$C_7$ feed that is fed to the Aromax reformer. The Aromax reformer is operated at 75 psig. The effluent from the Aromax reformer (stream 5) goes to a separator (6) to separate the gaseous effluent (stream 7) from the liquid effluent (stream 11). The gaseous effluent is routed to the recycle compressor (8). The compressed gaseous effluent (stream 9) exits the recycle compressor and is divided into a portion that is recycled to the Aromax reformer (stream 10), and a second portion, the net gas make (stream 12), which leaves the process and is sent to the conventional reformer circuit as described below. The Aromax reformer gas, which is the gaseous effluent from separator (6), has a hydrogen purity of 93.7 mole %. This is also true for the compressed gas (9) and the net gas (12). The net gas make (stream 12) is 14,604 lb/hr. None of the net gas make leaves the process via stream 12*a*. The bottoms stream (steam 14) from the $C_7/C_8$ splitter is predominately a $C_8$–$C_{10}$ feed. 12,955 BPOD or 141,002 lb/hr is fed to the conventional reformer (15) after combining with recycle gas stream 21*a*. The conventional reformer for this illustration of the invention contains a Pt/Sn/Cl on aluminia catalyst and is operated at 75 psig. The $H_2$/HC feed mole ratio is 4/1. The hydrogen partial pressure is 66 psia. The effluent from the conventional reformer, stream 16, is sent to separator (17) to separate the gaseous effluent (stream 18) from the liquid effluent (stream 23). The liquid effluent (stream 23) is produced at a rate of 118,653 lb/hr. A portion of the gaseous effluent, namely 15,741 lb/hr (stream 19), is passed to the recycle compressor (20) while 36,953 lb/hr (stream 22) leaves the process as net gas in this case. The resulting compressed gaseous stream is stream 21. The gaseous effluent (stream 18) is 84.9 mole % hydrogen. This hydrogen purity is also true for streams 19, 21 and 22. Stream 21, the compressed gas from the recycle compressor (20) with a hydrogen purity of 84.9 mole %, is combined with the 14,604 lb/hr of Aromax reformer net gas (stream 12*b*) which has a hydrogen purity of 93.7 mole %. The resulting combined gaseous stream 21*a*, has a mass flow rate of 30,345 lb/hr and a hydrogen purity of 90.1 mole %. The gas in stream 21*a* is combined with the $C_8$–$C_{10}$ feed (stream 14)

and fed to the conventional reformer (15). The liquid effluent (stream 23) from the conventional reformer is combined with 114,408 lb/hr of the liquid effluent (stream 11) from the Aromax reformer and the combined stream (stream 24) passed to the depentanizer (25). In the depentanizer the $C_5$-fraction (stream 26) is distilled overhead and the $C_{6^+}$ fraction (stream 27) is passed on for further processing (not shown). Further processing can include aromatic recovery as well as production of paraxylene and benzene product.

DETAILED DESCRIPTION OF THE INVENTION

In its broadest aspect, the present invention involves a process for reforming a full boiling hydrocarbon feed to enhance para-xylene and benzene yields.

In this process the hydrocarbon feed is separated into a $C_{5^-}$ cut, a $C_6$–$C_7$ cut, and a $C_{8^+}$ cut. The $C_6$–$C_7$ cut may contain up to 5 lv. % of $C_{8^+}$ hydrocarbon, and the $C_{8^+}$ cut may contain up to 10 lv. % of $C_{7^-}$ hydrocarbon. Each of the cuts may contain up to 20 lv. % of hydrocarbons outside the named range.

The $C_6$–$C_7$ cut is subjected to catalytic aromatization at elevated temperatures in a first reformer in the presence of hydrogen and using a mono-functional non-acidic catalyst comprising at least one Group VIII metal and a non-acidic zeolite support to produce a first reformate stream.

The $C_{8^+}$ cut is subjected to catalytic aromatization at elevated temperatures in a second reformer in the presence of hydrogen and using a bi-functional, acidic catalyst comprising at least one Group VIII metal and a metallic oxide support to produce a second reformate stream.

Non-acidic Catalysts

One of the catalysts used must be a non-acidic catalyst having a non-acidic zeolite support charged with one or more dehydrogenating constituents. This catalyst is also referred to as the monofunctional catalyst or as the non-acidic, monofunctional catalyst. Among the zeolites useful in the practice of the present invention are zeolite L, zeolite X, zeolite Y, mordenite, and ZSM-10 as well as other zeolite or molecular sieve materials that have a large pore size and preferably have a unidimensional channel structure. These zeolites have apparent pore sizes on the order of 7 to 9 Angstroms.

In the present application the terms "L zeolite" and "zeolite L" are used synonymously to refer to LTL type zeolite. Zeolite L is a synthetic crystalline zeolitic molecular sieve which may be written as:

$$(0.9\text{–}1.3)M_{2/n}O{:}Al_2O_3(5.2\text{–}6.9)SiO_2{\cdot}yH_2O$$

wherein M designates a cation, n represents the valence of M, and y may be any value from 0 to about 9. Zeolite L, its X-ray diffraction pattern, its properties, and method for its preparation are described in detail in U.S. Pat. No. 3,216,789. U.S. Pat. No. 3,216,789 is hereby incorporated by reference to show the preferred zeolite of the present invention. The real formula may vary without changing the crystalline structure; for example, the mole ratio of silicon to aluminum (Si/Al) may vary from 1.0 to 3.5.

Zeolite X is a synthetic crystalline zeolitic molecular sieve which may be represented by the formula:

$$(0.7\text{–}1.1\ )M_{2/n}O{:}Al_2O_3{:}(2.0\text{–}3.0)SiO_2{:}yH_2O$$

wherein M represents a metal, particularly alkali and alkaline earth metals, n is the valence of M, and y may have any value up to about 8 depending on the identity of M and the degree of hydration of the crystalline zeolite. Zeolite X, its X-ray diffraction pattern, its properties, and method for its preparation are described in detail in U.S. Pat. No. 2,882,244. U.S. Pat. No. 2,882,244 is hereby incorporated by reference to show a zeolite useful in the present invention. Zeolite Y is a synthetic crystalline zeolitic molecular sieve which may be written as:

$$(0.7\text{–}1.1)Na_2O{:}Al_2O_3{:}xSiO_2{:}yH_2O$$

wherein x is a value greater than 3 up to about 6 and y may be a value up to about 9. Zeolite Y has a characteristic X-ray powder diffraction pattern which may be employed with the above formula for identification. Zeolite Y is described in more detail in U.S. Pat. No. 3,130,007. U.S. Pat. No. 3,130,007 is hereby incorporated by reference to show a zeolite useful in the present invention. ZSM-10 is described in more detail in U.S. Patent Number 3,692,470 which is hereby incorporated by reference. Another reference that describes the synthesis and structure of ZSM-10 is in *Zeolites* 16:236–244, 1996 written by J. B. Higgins and K. D. Schmitt, and published by Elsevier Sicence Inc.

The preferred non-acidic catalyst is a type L zeolite charged with one or more dehydrogenating constituents.

The zeolitic catalysts according to the invention are charged with one or more Group VIII metals, e.g., nickel, ruthenium, rhodium, palladium, iridium or platinum. The preferred Group VIII metals are iridium and particularly platinum, which are more selective with regard to dehydrocyclization and are also more stable under the dehydrocyclization reaction conditions than other Group VIII metals. The preferred percentage of platinum in the dehydrocyclization catalyst is between 0.1% and 5%, the lower limit corresponding to minimum catalyst activity and the upper limit to maximum activity. This allows for the high price of platinum, which does not justify using a higher quantity of the metal since the result is only a slight improvement in catalyst activity.

Group VIII metals are introduced into the large-pore zeolite by synthesis, impregnation or exchange in an aqueous solution of appropriate salt. When it is desired to introduce two Group VIII metals into the zeolite, the operation may be carried out simultaneously or sequentially.

By way of example, platinum can be introduced by impregnating the zeolite with an aqueous solution of tetrammineplatinum (II) nitrate, tetrammineplatinum (II) hydroxide, dinitrodiamino-platinum or tetrammineplatinum (II) chloride. In an ion exchange process, platinum can be introduced by using cationic platinum complexes such as tetrammineplatinum (II) nitrate.

A preferred, but not essential, element of the present invention is the presence of an alkaline earth metal in the dehydrocyclization catalyst. That alkaline earth metal can be either barium, strontium or calcium. Preferably the alkaline earth metal is barium. The alkaline earth metal can be incorporated into the zeolite by synthesis, impregnation or ion exchange. Barium is preferred to the other alkaline earths because the resulting catalyst has high activity, high selectivity and high stability. An inorganic oxide may be used as a carrier to bind the large-pore zeolite containing the Group VIII metal. The carrier can be a natural or a synthetically produced inorganic oxide or combination of inorganic oxides. Typical inorganic oxide supports which can be used include clays, alumina, and silica, in which acidic sites are preferably exchanged by cations that do not impart strong acidity.

The non-acidic catalyst can be employed in any of the conventional types of equipment known to the art. It may be employed in the form of pills, pellets, granules, broken fragments, or various special shapes, disposed as a fixed bed within a reaction zone, and the charging stock may be passed therethrough in the liquid, vapor, or mixed phase, and in either upward or downward flow. Alternatively, it may be prepared in a suitable form for use in moving beds, or in fluidized-solid processes, in which the charging stock is passed upward through a turbulent bed of finely divided catalyst.

According to another preferred embodiment of the present invention, the zeolite L based catalyst is produced by treatment in a gaseous environment in a temperature range between 1025° F. and 1275° F. while maintaining the water level in the effluent gas below 1000 ppm. Preferably, the high temperature treatment is carried out at a water level in the effluent gas below 200 ppm. Preferred high temperature treated catalysts are described in the Mulaskey et al. patents, U.S. Pat. No. 5,382,353 and U.S. Pat. No. 5,620,937, which references are incorporated by reference herein, particularly as to description of high temperature treated Pt L zeolite catalysts. U.S. Pat. No. 5,382,353 and U.S. Pat. No. 5,620,937 to Mulaskey et al. disclose a zeolite L based reforming catalyst wherein the catalyst is treated at high temperature and low water content to thereby improve the stability of the catalyst, that is, to lower the deactivation rate of the catalyst under reforming conditions.

According to another preferred embodiment of the present invention, the zeolite L based catalyst contains at least one halogen in an amount between 0.1 and 2.0 wt. % based on zeolite L. Preferably, the halogens are fluorine and chlorine and are present on the catalyst in an amount between 0.1 and 1.0 wt. % fluorine and 0.1 and 1.0 wt. % chlorine at the Start of Run. Recently, several patents and patent applications of RAULO (Research Association for Utilization of Light Oil) and Idemitsu Kosan Co. have been published relating to use of halogen in zeolite L based monofunctional reforming catalysts. Such halogen containing monofunctional catalysts have been reported to have improved stability (catalyst life) when used in catalytic reforming, particularly in reforming feedstocks boiling above $C_7$ hydrocarbons in addition to $C_6$ and $C_7$ hydrocarbons. In this regard, see EP 201,856A; EP 498,182A; U.S. Pat. No. 4,681,865; and U.S. Pat. No. 5,091,351.

Preferred halogen containing catalysts are described in the RAULO and IKC patents cited above, which references are incorporated by reference herein, particularly as to description of halogen containing Pt L zeolite catalysts.

According to an alternative embodiment of the present invention the catalyst used in the present invention can comprise Pt and Bismuth on halogenated non-acidic zeolite L support as disclosed in copending U.S. patent application Ser. No. 08/995,588.

According to another alternative embodiment of the present invention the catalyst used in the present invention can comprise Pt and a Group I B Metal on a halogenated non-acidic zeolite L support as disclosed in copending U.S. patent application Ser. No. 09/134,164.

U.S. patent application Ser. Nos. 08/995,588 and 09/134,164 are herein incorporated by reference.

Acidic Catalysts

Traditional or conventional reforming catalysts are bifunctional, in that they have an acidic function and a metallic function. An acidic catalyst is used in conjunction with the non-acidic catalyst in the present Invention. The acidic catalyst can comprise a metallic oxide support having disposed therein a Group VIII metal. Suitable oxide supports include alumina and silica. Preferably, the acidic catalyst comprises a oxide support having disposed therein in intimate admixture a Group VIII metal (preferably platinum) and a Group VIII metal promoter, such as rhenium, tin, germanium, cobalt, nickel, iridium, rhodium, ruthenium and combinations thereof. More preferably, the acidic catalyst comprises an alumina support, platinum, and rhenium. A preferred acidic catalyst comprises platinum and tin on an alumina support.

Preferably, the acidic catalyst has not been presulfided before use if there is a risk of contaminating the preferred monofunctional, non-acidic catalyst. On the other hand, if one can insure no sulfur contamination of the non-acidic catalyst from the reformate or gas produced by the acidic catalyst, then one might be able to use a presulfided catalyst, such as Pt/Re on alumina. Examples of bifunctional catalysts include platinum on acidic alumina as disclosed in U.S. Pat. No. 3,006,841 to Haensel; platinum-rhenium on acidic alumina as disclosed in U.S. Pat. No. 3,415,737 to Kluksdahl; platinum-tin on acidic alumina; and platinum-iridium with bismuth on an acidic carrier as disclosed in U.S. Pat. No. 3,878,089 to Wilhelm all of which are hereby incorporated by reference.

Reforming Conditions

The reforming in both reformers is carried out in the presence of hydrogen at a pressure adjusted to favor the dehydrocyclization reaction thermodynamically and to limit undesirable hydrocracking reactions. The pressures used preferably vary from 1 atmosphere to 500 psig, more preferably from 50 to 300 psig, and still more preferably 40 to 150 psig, the molar ratio of hydrogen to hydrocarbons preferably being from 1:1 to 10:1, more preferably from 2:1 to 6:1.

In the temperature range of from 400° C. to 600° C., the dehydrocyclization reaction occurs with acceptable speed and selectivity. If the operating temperature is below 400° C., the reaction speed is insufficient and consequently the yield is too low for industrial purposes. When the operating temperature of dehydrocyclization is above 600° C., interfering secondary reactions such as hydrocracking and coking occur, and substantially reduce the yield. It is not advisable, therefore, to exceed the temperature of 600° C. The preferred temperature range (430° C. to 550° C.) of dehydrocyclization is that in which the process is optimum with regard to activity, selectivity and the stability of the catalyst.

The liquid hourly space velocity of the hydrocarbons in the dehydrocyclization reaction is preferably between 0.3 and 5.

Sulfur Sensitivity of Monofunctional Reforming Catalyst

It has been found that the particularly preferred non-acidic, monofunctional catalyst used in the present Invention namely Pt L zeolite, is particularly sensitive to sulfur. In the present invention, the feed contacting the preferred monofunctional catalyst preferably contains less than 50 ppb sulfur, more preferably less than 10 ppb sulfur. U.S. Pat. No. 4,456,527 which is hereby incorporated by reference discloses the surprising finding that if the sulfur content of the feed was reduced to ultra low levels, below levels used in the past for catalysts especially sensitive to sulfur, that then long run lengths could be achieved with the L-zeolite non-acidic catalyst. Specifically, it was found that the concentration of sulfur in the hydrocarbon feed to the L-zeolite catalyst should be at ultra low levels to achieve improved stability/activity for the catalyst used.

In the present invention, low catalyst deactivation rates are important. Ultra low sulfur in the feed contributes to the success of the present invention.

Hydrogen Purity

It has been found that a non-acidic, monofunctional reformer produces offgas of surprisingly high purity having 88 to 95 mole % hydrogen content, preferably 90 to 95 %, more preferably 92 to 94% without any special purification. A bifunctional, acidic reformer produces an off gas having a hydrogen content lower than this, generally less than 88 mole % hydrogen. Reformers operated at high severity often produce an offgas having a hydrogen purity much less than 88 mole %.

Although not wishing to be bounded by theory the difference in hydrogen purities is probably due to the presence of more hydrocracking reactions occurring in the bifunctional reformer due at least in part to the acidic component of the bifunctional catalyst. The non-acidic, monofunctional reformer used in the present invention has very little, if any acidic sites on the catalyst. Such a catalyst performs predominantly dehydrocyclization, and dehydrogenation reactions and has much lower cracking activity than do bifunctional catalysts. The cracking reactions produce most of the light impurities. It is thought this difference in catalyst functionality accounts for the difference in hydrogen purity of the respective hydrogen gas containing streams produced.

In an alternative embodiment of the present invention where hydrogen from a non-acidic mono-functional reformer is sent to a bifunctional reformer producing $C_8$ aromatics comprising xylenes the present invention is particularly advantageous. The feed to the bifunctional reformer may be a $C_6$–$C_{10}$ cut, a $C_7$–$C_9$ cut, a $C_6$–$C_8$ cut, a $C_8$–$C_{10}$ cut, or any variation thereof preferably including $C_8$ nonaromatics. To produce xylenes from the resultant reformate suitable for use as a feed to a high purity paraxylene purification process, low levels of non-aromatics in the xylenes boiling range are highly desirable. One way to produce such a xylenes cut, low in non-aromatics, is by an aromatics extraction process such as UDEX or Sulfolane to separate the non-aromatics from the aromatics. Another way is to run the reformer at a very high severity (e.g. to produce a reformate having greater than 100 octane, preferably greater than 102 octane). At very high severity the hydrogen produced is particularly high in impurities. This is probably due to more cracking at the very high severity producing light components that end up in the off-gas. However the non-aromatics in the $C_8$ boiling range are also cracked at very high severity thus producing a $C_8$ aromatics product low in non-aromatics. Production of paraxylene (PX) from unextracted xylenes is advantageous because it eliminates the extraction step and provides a significant cost saving. The present invention is particularly advantageous for producing PX using unextracted xylenes because one can operate the bifunctional reformer at very high octanes without sacrificing the hydrogen purity reaching the bifunctional catalyst. Prior art processes would require either a greatly increased recycle rate or a greatly reduced catalyst run length due to a lower Hydrogen to Hydrocarbon mole ratio or a combination of a higher recycle rate and a reduced run length. As mentioned elsewhere in this application increasing the recycle rate due to lower hydrogen purity requires increased compressor horsepower and demands more energy (higher utility costs). Also more light impurities are fed across the catalyst contributing to coking. Reduced run length of the catalyst caused by more rapid coke formation results from lowering the hydrogen/hydrocarbon mole ratio and requires more frequent catalyst regeneration/rejuvenation and ultimately to higher catalyst costs and related costs for shutdowns and replacement of the catalyst as well as other increased operating costs associated with a poorer performing catalyst.

Split Feed, Parallel Aromatization with Monofunctional and Bifunctional Catalyst An alternate embodiment of the invention is a process for making high purity benzene and high purity paraxylene, which includes the step of splitting a naphtha feed stream into a $C_{7^-}$ light fraction and a $C_{8^+}$ heavy fraction, then reforming each fraction separately. The light fraction may be reformed (aromatized) in the presence of a non-acidic monofunctional catalyst, and the heavy fraction may be reformed (aromatized) in the presence of an acidic bifunctional catalyst.

In accordance with this process, the heavy fraction reformate can have a surprisingly high concentration of aromatics, measured as octane number, specifically, an RON of 102 to 108. This high octane number can be accomplished under conventional reforming conditions. That is, reforming is done at: pressures varying from I atmosphere to 500 psig, more preferably from 50 to 300 psig; a molar ratio of hydrogen to hydrocarbons from 1:1 to 10:1, more preferably from 2:1 to 6:1; temperatures from 400° C. to 600° C., preferably from 430° C. to 550° C.; and a liquid hourly space velocity of between 0.3 and 5.

The $C_8$ aromatic fraction that results from this high octane heavy reformate is particularly well suited as the feedstock for the production of paraxylene. As discussed elsewhere in this patent application the $C_8$ aromatic fraction produced at high severity has a low non-aromatic content and can be fed to a paraxylene (PX) purification process without first being subjected to liquid-liquid extraction to remove the non-aromatics. Non-aromatics are at best undesirable diluents in PX separation processes and can build up in the desorbent of adsorption type PX separation processes. Non-aromatics also lead to higher utility costs in crystallization type processes by requiring lower crystallization temperatures and thus more refrigeration. Xylenes isomerization units are also adversely effected by high non-aromatics levels. Non-aromatics crack in xylenes isom units forming light byproducts and coking. Non-aromatics also take up space in the isom loop displacing xylenes.

The present invention allows production of a very high octane $C_8$ aromatic reformate particularly well suited for PX production while also minimizing hydrogen gas recycle rate and/or minimizing fouling rate of the catalyst. Prior art processes require either greatly increasing the gas recycle rate to the catalyst or sacrificing catalyst life due to the poor quality hydrogen gas produced at high severities.

Carburization Protection for Monofunctional Reformer

It is desirable that the metal surfaces or the heat exchange surfaces that contact the hydrocarbons and aromatics at elevated temperatures and at ultra low sulfur conditions are made of a material having a resistance to carburization and metal dusting at least as great as that of type 347 stainless steel under low sulfur reforming conditions.

In a preferred embodiment of the invention, the reformer's metal surfaces can be made of (a) 347 stainless steel or a steel having a resistance to carburization and metal dusting at least as great as 347 stainless steel; or (b) the furnace tubes can be treated by a method comprising plating, cladding, painting or coating the surfaces for contacting the feed to provide improved resistance to carburization and metal dusting; or (c) the surfaces can be constructed of or lined with a ceramic material. More preferably the metal surfaces are constructed of a type 300 series steel provided with an intermetallic coating on the surfaces for contacting the feed.

In one embodiment of the invention, the metal surfaces of the reformer have a metal-containing coating, cladding, plating, or paint applied to at least a portion (preferably at least 50%, more preferably at least 75% and most preferably to all) of the surface area that is to be contacted with hydrocarbons at process temperature. After coating, the metal-coated reactor system is preferably heated to produce intermetallic and/or metal carbide layers. A preferred metal-coated reactor system preferably comprises a base construction material (such as a carbon steel, a chromium steel, or a stainless steel) having one or more adherent metallic layers attached thereto. Examples of metallic layers include elemental chromium and iron-tin intermetallic compounds such as $FeSn_2$.

As used herein, the term "metal-containing coating" or "coating" is intended to include claddings, platings, paints and other coatings which contain either elemental metals, metal oxides, organometallic compounds, metal alloys, mixtures of these components and the like. The metal(s) or metal compounds are preferably a key component(s) of the coating. Flowable paints that can be sprayed or brushed are a preferred type of coating. In a preferred embodiment, the coated steel is heat treated to produce intermetallic compounds, thus reacting the coating metal with the steel.

Especially preferred are metals that interact with, and preferably react with, the base material of the reactor system to produce a continuous and adherent metallic protective layer at temperatures below or at the intended hydrocarbon conversion conditions. Metals that melt below or at reforming process conditions are especially preferred as they can more readily provide complete coverage of the substrate material. These metals include those selected from among tin, antimony, germanium, arsenic, bismuth, aluminum, gallium, indium, copper, lead, and mixtures, intermetallic compounds and alloys thereof. Preferred metal-containing coatings comprise metals selected from the group consisting of tin, antimony, germanium, arsenic, bismuth, aluminum, and mixtures, intermetallic compounds and alloys of these metals. Especially preferred coatings include tin-, antimony- and germanium-containing coatings. These metals will form continuous and adherent protective layers. Tin coatings are especially preferred—they are easy to apply to steel, are inexpensive and are environmentally benign.

It is preferred that the coatings be sufficiently thick that they completely cover the base metallurgy and that the resulting protective layers remain intact over years of operation. For example, tin paints may be applied to a (wet) thickness of between 1 to 6 mils, preferably between about 2 to 4 mils. In general, the thickness after curing is preferably between about 0.1 to 50 mils, more preferably between about 0.5 to 10 mils.

Metal-containing coatings can be applied in a variety of ways, which are well known in the art, such as electroplating, chemical vapor deposition, and sputtering, to name just a few. Preferred methods of applying coatings include painting and plating. Where practical, it is preferred that the coating be applied in a paint-like formulation (hereinafter "paint"). Such a paint can be sprayed, brushed, pigged, etc. on reactor system surfaces.

One preferred protective layer is prepared from a metal-containing paint. Preferably, the paint comprises or produces a reactive metal that interacts with the steel. Tin is a preferred metal and is exemplified herein; disclosures herein about tin are generally applicable to other metals such as germanium. Preferred paints comprise a metal component selected from the group consisting of: a hydrogen decomposable metal compound such as an organometallic compound, finely divided metal and a metal oxide, preferably a metal oxide that can be reduced at process or furnace tube temperatures In a preferred embodiment the cure step produces a metallic protective layer bonded to the steel through an intermediate bonding layer, for example a carbide-rich bonding layer, as described in U.S. Pat. No. 5,674,376, which is incorporated herein by reference in its entirety. This patent describes some preferred coatings and paint formulations. One especially preferred tin paint contains at least four components or their functional equivalents: (i) a hydrogen decomposable tin compound, (ii) a solvent system, (iii) finely divided tin metal and (iv) tin oxide. As the hydrogen decomposable tin compound, organometallic compounds such as tin octanoate or neodecanoate are particularly useful. Component (iv), the tin oxide is a porous tin-containing compound that can sponge-up the organometallic tin compound, and can be reduced to metallic tin. The paints preferably contain finely divided solids to minimize settling. Finely divided tin metal, component (iii) above, is also added to insure that metallic tin is available to react with the surface to be coated at as low a temperature as possible. The particle size of the tin is preferably small, for example one to five microns. Tin forms metallic stannides (e.g., iron stannides and nickel/iron stannides) when heated under reducing conditions, e.g. in the presence of hydrogen.

In one embodiment, there can be used a tin paint containing stannic oxide, tin metal powder, isopropyl alcohol and 20% Tin Ten-Cem (manufactured by Mooney Chemical Inc., Cleveland, Ohio). Twenty percent Tin Ten-Cem contains 20% tin as stannous octanoate in octanoic acid or stannous neodecanoate in neodecanoic acid. When tin paints are applied at appropriate thicknesses, heating under reducing conditions will result in tin migrating to cover small regions (e.g., welds) which were not painted. This will completely coat the base metal.

Additional information on the composition of tin protective layers is disclosed in U.S. Pat. No. 5,406,014 to Heyse et al., which is incorporated herein by reference. Here it is taught that a double layer is formed when tin is coated on a chromium-rich, nickel-containing steel. Both an inner chromium-rich layer and an outer stannide layer are produced. The outer layer contains nickel stannides. When a tin paint was applied to a 304 type stainless steel and heated at about 1200° F., there resulted a chromium-rich steel layer containing about 17% chromium and substantially no nickel, comparable to 430 grade stainless steel.

Tin/iron paints are also useful in the present invention. A preferred tin/iron paint will contain various tin compounds to which iron has been added in amounts up to one third Fe/Sn by weight. The addition of iron can, for example, be in the form of $Fe_2O_3$. The addition of iron to a tin containing paint should afford noteworthy advantages; in particular: (i) it should facilitate the reaction of the paint to form iron stannides thereby acting as a flux; (ii) it should dilute the nickel concentration in the stannide layer thereby providing a coating having better protection against coking; and (iii) it should result in a paint which affords the anti-coking protection of iron stannides even if the underlying surface does not react well.

Some of the coatings, such as the tin paint described above, are preferably cured, for example, by heat treatment. Cure conditions depend on the particular metal coating and curing conditions that are selected so as to produce an adherent protective layer. Gas flow rates and contacting time depend on the cure temperature used, the coating metal and the specific components of the coating composition.

The coated materials are preferably cured in the absence of oxygen. If they are not already in the metallic state, they are preferably cured in a hydrogen-containing atmosphere at elevated temperatures. Cure conditions depend on the coating metal and are selected so they produce a continuous and uninterrupted protective layer that adheres to the steel substrate. The resulting protective layer is able to withstand repeated temperature cycling, and does not degrade in the reaction environment. Preferred protective layers are also useful in reactor systems that are subjected to oxidizing environments, such as those associated with coke bum-off.

In general, the contacting of the reactor system having a metal-containing coating, plating, cladding, paint or other coating applied to a portion thereof with hydrogen is done for a time and at a temperature sufficient to produce a metallic protective layer. These conditions may be readily determined. For example, coated coupons may be heated in the presence of hydrogen in a simple test apparatus; the formation of the protective layer may be determined using petrographic analysis.

It is preferred that cure conditions result in a protective layer that is firmly bonded to the steel. This may be accomplished, for example, by curing the applied coating at elevated temperatures. Metal or metal compounds contained in the paint, plating, cladding or other coatings are preferably cured under conditions effective to produce molten metals and/or compounds. Thus, germanium and antimony paints are preferably cured between 1000° F. and 1400° F. Tin paints are preferably cured between 900° F. and 1100° F. Curing is preferably done over a period of hours, often with temperatures increasing over time. The presence of hydrogen is especially advantageous when the paint contains reducible oxides and/or oxygen-containing organometallic compounds.

As an example of a suitable paint cure for a tin paint, the system including painted portions can be pressurized with flowing nitrogen, followed by the addition of a hydrogen-containing stream. The reactor inlet temperature can be raised to 800° F. at a rate of 50–100° F./hr. Thereafter the temperature can be raised to a level of 950–975° F. at a rate of 50° F./hr, and held within that range for about 48 hours.

EXAMPLES

Example 1

A $C_{8+}$ naphtha feed was prepared from a $C_6$–$C_{10}$ wide-boiling range naphtha for reforming over a bifunctional acidic catalyst. Feed composition of the $C_{8+}$ feed and some of its properties are as follows:

| Carbon No. Distribution, wt % | |
|---|---|
| $C_{6-}$ | 0.05 |
| $C_7$ | 9.01 |
| $C_8$ | 43.33 |
| $C_9$ | 31.92 |
| $C_{10}$ | 15.13 |
| $C_{11+}$ | 0.56 |
| Paraffins-wt % | 65.13 |
| Naphthenes-wt % | 15.73 |
| Aromatics-wt % | 14.94 |
| Olefins-wt % | 0.00 |
| Unclassified | 4.20 |
| ASTM D-86[1], F | |
| LV-% | |
| 0 | 239 |
| 10 | 245 |
| 50 | 275 |
| 90 | 326 |
| 100 | 363 |
| API Gravity | 57.9 |

[1]Simulated D-86 by Gas Chromatography

Example 2

A commercially available acidic bifunctional reforming catalyst, chlorided Pt/Sn on alumina, was charged to a 1-inch diameter reactor. The total catalyst charge was 49.5 grams. The reactor was part of a large unit equipped with a recycle gas compressor system, low temperature separator and a debutanizer. The feed from Example 1 was passed over the catalyst charge. Operating conditions were a pressure of 75 PSIG, a LHSV of 1-$hr^{-1}$, a hydrogen/hydrocarbon feed ($H_2$/HC) mole ratio of 3/1 and an average reactor temperature of 943 F. The reactor inlet hydrogen partial pressure was 59.3 PSIA. With the separator operating at 67 F, the composition of the off-gas from the separator was as shown below. Part of the off-gas from the separator is recycled back to the reactor and part is excessed as net gas to control reactor system pressure.

| Recycle Gas Composition - Mole % | |
|---|---|
| Hydrogen | 84.9 |
| Hydrocarbon | 15.1 |

Example 3

Example 2 was repeated except that the average reactor temperature was increased to 960 degrees F. In this case, the recycle gas had a lower hydrogen purity than that in Example 2 as shown below.

| Recycle Gas Composition - Mole % | |
|---|---|
| Hydrogen | 80.5 |
| Hydrocarbon | 19.5 |

Example 4

A $C_6$–$C_7$ naphtha containing 75% $C_6$ and 24% $C_7$ with an API Gravity of 73.0 was processed in the same manner as described in Example 2, except that the catalyst charged to the reactor was a non-acidic mono-functional aromatization catalyst. The feed contained 4.1 wt % aromatics with the rest being paraffins and naphthenes. The catalyst was a Pt containing K/Ba L zeolite (trademark AROMAX). Reactor inlet pressure was 75 PSIG, reactor temperature averaged 900 F and the $H_2$/HC feed mole ratio was 5.0/1. With the separator operating at 96 F, the recycle gas composition was as follows:

| Recycle Gas Composition - Mole % | |
|---|---|
| Hydrogen | 93.7 |
| Hydrocarbon | 6.3 |

Had the separator been operating at 60 F, the hydrogen purity of the recycle gas would have been about 95%.

Example 5

A $C_6$–$C_{10}$ wide boiling range naphtha was first distilled to provide a $C_6$–$C_7$ overhead cut and a $C_{8+}$ bottoms cut. The $C_{8+}$ bottoms cut is described in Example 1 and the $C_6$–$C_7$ cut is described in Example 4.

The $C_{8+}$ cut was reformed as in Example 2 and the $C_6$–$C_7$ cut was aromatized as in Example 4. FIG. 1 as well as in the detailed description of FIG. 1, shows the overall material balance when processing 25,755 BPOD of the $C_6$–$C_{10}$ naphtha as described above. Note that the net gas available for export from the non-acidic aromatization catalyst is 14,604 LB/Hr while that from the Pt/Sn reforming catalyst is 22,349 LB/Hr. Also note that the net gas from the non-acidic aromatization catalyst has a hydrogen purity of 93.7% while that from the Pt/Sn reforming catalyst has a hydrogen purity of 84.9%.

Example 6

This example describes the key embodiment of the invention. A $C_6$–$C_{10}$ wide boiling range naphtha was processed as described in Example 5. The $C_6$–$C_{10}$ wide boiling range naphtha was distilled to provide a $C_6$–$C_7$ overhead cut and a $C_{8+}$ bottoms cut. The $C_6$–$C_7$ cut was aromatized over a non-acidic monofunctional catalyst as described in Example 4, and the $C_{8+}$ cut was reformed over a bifunctional acidic reforming catalyst as described in Example 2. To take advantage of the higher hydrogen purity (93.7%) net gas from the monofunctional aromatization catalyst relative to the lower hydrogen purity (84.9%) net gas from the bifunctional reforming catalyst, and to further extend the catalyst life of the bifunctional reforming catalyst, the net gas (14,604 LB/Hr) from the monofunctional non-acidic aromatization catalyst was added to the recycle gas of the bifunctional reforming catalyst, displacing an equal amount of the lower hydrogen purity recycle gas. This displacement is necessary to maintain the material balance. Thus the net gas make from the bifunctional reforming catalyst is 36,953 LB/Hr as shown in FIG. 2 as well as in the detailed description of FIG. 2. The recycle gas to the bifunctional reforming catalyst is still 30,345 LB/Hr as in Example 2, however because of the addition of the higher purity hydrogen gas from the monofunctional aromatization process, the hydrogen purity of the recycle gas to the bifunctional reforming catalyst is now increased to 90.1%, up from 84.9%. This increased purity in the recycle gas translates to an increase in the $H_2$/HC feed mole ratio from 3/1 (as in Example 2) to 4/1. More importantly, the hydrogen partial pressure is increased to 66 PSIA from 59.3 PSIA per Example 2. This represents an 11.3% increase in hydrogen partial pressure and should result in a substantial increase in the life of the bifunctional acidic reforming catalyst. It is well known to one skilled in the art, that increasing the hydrogen partial pressure increases the life of the reforming catalyst (bifunctional, acidic) or aromatization (monofunctional, non-acidic) catalyst.

Example 7

This example describes another embodiment of the invention, wherein an increased catalyst life of the bifunctional acidic reforming catalyst is not desired, but where the objective is to maintain a constant $H_2$/HC feed mole ratio, i.e. a constant hydrogen partial pressure. Operation in this mode results in a reduction in the electrical utility requirement to operate the recycle compressor. In this example, operation is as described in Example 6, however, the goal is to maintain the same $H_2$/HC feed mole ratio of 3/1 for the bifunctional reforming catalyst as in Example 2. This can be achieved by reducing the recycle gas rate to the bifunctional reforming catalyst from 30,345 LB/Hr as in Example 6 and after addition of the higher purity gas from the monofuctional aromatization catalyst, to 18,445 LB/hr (hydrogen purity of 90.1%). This 11,900 LB/Hr reduction-from 30,345 LB/Hr to 18,445 LB/hr, represents a 39.3% reduction in the recycle gas mass flow rate. Since the recycle compressor horsepower requirement is directly proportional to the mass flow rate, operation in this mode results in a 39.3% reduction in the horsepower requirement and hence a 39.3% reduction in power requirement or electrical utility cost. Indeed, the electrical utility savings is more than 39.3% because the total flowrate (i.e. recycle gas rate plus hydrocarbon feed) to the reactor system is lower by 6.9%. Because of the lower total flowrate to the reactor system, the pressure drop through the system is lower resulting in a higher pressure at the compressor suction and hence a lower compression ratio. This lower compression ratio will further reduce the horsepower requirement. The compression ratio is the ratio of the compressor discharge to suction pressure in PSIA. Adiabatic compressor horsepower (HP) is calculated from the following equation:

$$HP=W*(k/(k-1))*RT_1/(550)*((P_2/P_1)^{(k-1)})/k-1)$$

Where:

W=weight of gas in lb/sec.

$k=c_p/c_v$, ratio of specific heats at constant pressure and volume

R=gas constant—Ft-LB/Mole-° R $T_1$=suction temperature—° R $P_1$=suction pressure—PSIA $P_2$=discharge pressure—PSIA

What is claimed is:

1. A process for reforming a full boiling hydrocarbon feed comprising:

a) separating the hydrocarbon feed into a $C_{5-}$ cut, a $C_6$–$C_7$ cut, and a $C_{8+}$ cut;

b) subjecting the $C_6$–$C_7$ cut to catalytic aromatization at elevated temperatures in a first reformer in the presence of hydrogen and using a non-acidic catalyst comprising at least one Group VIII metal and a non-acidic zeolite to produce a first reformate stream comprising benzene and a first gaseous stream comprising hydrogen; and c) subjecting the $C_{8+}$ cut in the presence of a hydrogen feed to catalytic aromatization at elevated temperatures in a second reformer and using an acidic catalyst comprising at least one Group VIII metal and a support to produce a second reformate stream comprising $C_8$ aromatics including xylenes and a second gaseous stream comprising hydrogen;

wherein at least a part of said first gaseous stream is fed to the second reformer to provide at least a part of said hydrogen feed.

2. A process for reforming hydrocarbons in two reforming zones operated in parallel, comprising:

(a) reforming hydrocarbons comprising a $C_6$–$C_7$ cut over a monofunctional, non-acidic aromatization catalyst at reforming conditions to form a reformate comprising benzene and a gas comprising hydrogen having a hydrogen purity of at least 88 mole %, and (b) feeding at least a portion of the gas comprising hydrogen and a hydrocarbon feed comprising a $C_{8^+}$ cut to a bifunctional reformer under reforming conditions to form a $C_8$ aromatic product comprising xylenes.

3. The process of claim 1 wherein said first gaseous stream comprises at least 90 mole % hydrogen.

4. The process of claim 1 wherein essentially all of said hydrogen feed to catalytic aromatization of the $C_{8^+}$ cut comprises said first gaseous stream.

5. The process of claim 1 wherein said first gaseous stream comprises at least 92 mole % hydrogen.

6. The process of claim 1 wherein the non-acidic zeolite is a large pore zeolite having unidimensional channel structure.

7. The process of claim 1 wherein the non-acidic zeolite is selected from the group consisting of zeolite L, ZSM-10, and mordenite.

8. The process of claim 1 wherein the non-acidic catalyst comprises a group VIII metal which is platinum.

9. The process of claim 1 wherein the non-acidic zeolite is zeolite L.

10. The process of claim 1 wherein the acidic catalyst is selected from a group consisting of platinum-tin on alumina, platinum rhenium on alumina, platinum on alumina, and platinum-iridium on alumina, and Pt Cs on Beta zeolite.

11. The process of claim 1 wherein the non-acidic catalyst comprises platinum zeolite L.

12. A process for reforming hydrocarbons in two reforming zones comprising:

a) reforming hydrocarbons comprising a $C_{6^+}$ cut over a monofunctional, non-acidic aromatization catalyst at reforming conditions to form a reformate comprising benzene and a gas comprising hydrogen having a hydrogen purity of at least 88 mole %, and b) feeding at least a portion of the gas comprising hydrogen and a hydrocarbon feed comprising naphtha to a bifunctional reformer comprising a bifunctional reforming catalyst, under reforming conditions to form a second reformate.

13. The process of claim 12 wherein the monofunctional, non-acidic aromatization catalyst is platinum L zeolite.

14. The process of claim 13 wherein the bifunctional reforming catalyst is selected from a group consisting of platinum-tin on alumina, platinum-rhenium on alumina, platinum on alumina, platinum-iridium on alumina, and Pt Cs on Beta zeolite.

15. The process of claim 2 wherein said gas comprising hydrogen contains at least 90 mole % hydrogen.

16. The process of claim 2 wherein said gas comprising hydrogen contains at least 92 mole % hydrogen.

17. The process of claim 1 wherein the first reformer and the second reformer share a common recycle compressor.

* * * * *